United States Patent [19]

Meyers

[11] 4,283,001

[45] Aug. 11, 1981

[54] TUBULAR CARTON WITH POLYGONAL CROSS-SECTION

[75] Inventor: George L. Meyers, Ashland, Ohio

[73] Assignee: American Can Company, Greenwich, Conn.

[21] Appl. No.: 92,692

[22] Filed: Nov. 9, 1979

[51] Int. Cl.[3] ..... B65D 5/36; B65D 5/10

[52] U.S. Cl. ..... 229/37 R; 229/DIG. 11

[58] Field of Search ..... 229/37 R, 38, DIG. 11

[56] References Cited

U.S. PATENT DOCUMENTS

| | | | |
|---|---|---|---|
| 2,067,998 | 1/1937 | Williamson | 229/38 X |
| 2,114,052 | 4/1938 | Kincade, Jr. | 229/37 R |
| 2,440,836 | 5/1948 | Turngren | 229/DIG. 11 |
| 2,967,655 | 1/1961 | Seger, Jr. | 229/37 R |
| 3,079,062 | 2/1963 | Craddock et al. | 229/37 R X |
| 3,253,769 | 5/1966 | Opler | 229/38 |
| 3,361,329 | 1/1968 | Fox | 229/38 |
| 3,790,019 | 2/1974 | Murray et al. | 229/DIG. 11 |
| 4,017,017 | 4/1977 | Vos | 229/38 |
| 4,063,679 | 12/1977 | Henry | 229/37 R |
| 4,166,565 | 9/1979 | Webinger | 229/37 R X |

*Primary Examiner*—Davis T. Moorhead
*Attorney, Agent, or Firm*—Robert P. Auber

[57] ABSTRACT

Hollow tubular container of irregular configuration in cross-section collapsible into flat condition.

8 Claims, 14 Drawing Figures

FIG.1
B+C+D = A+E+F
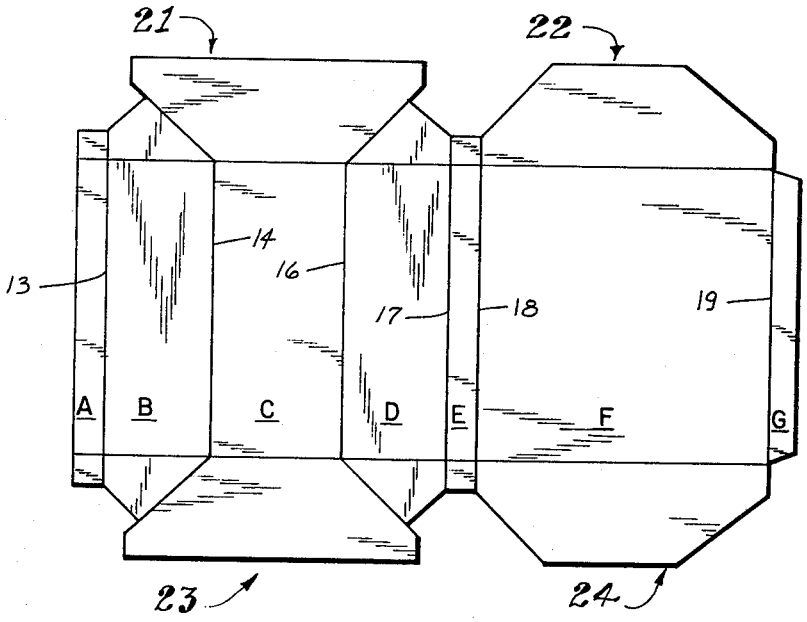
FIG.2
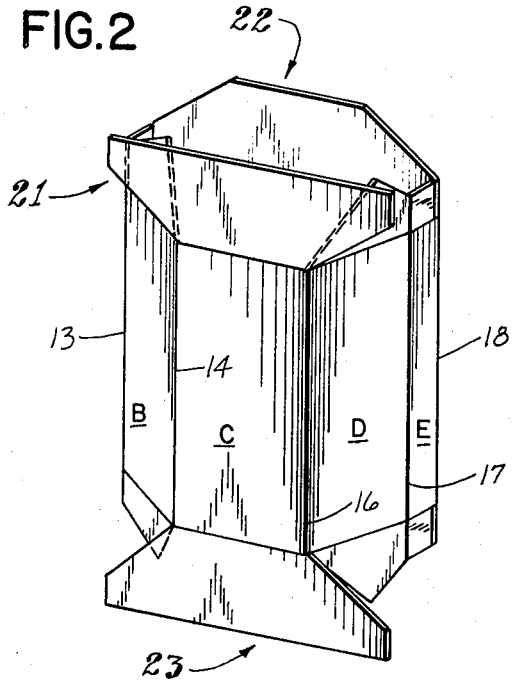
FIG.3
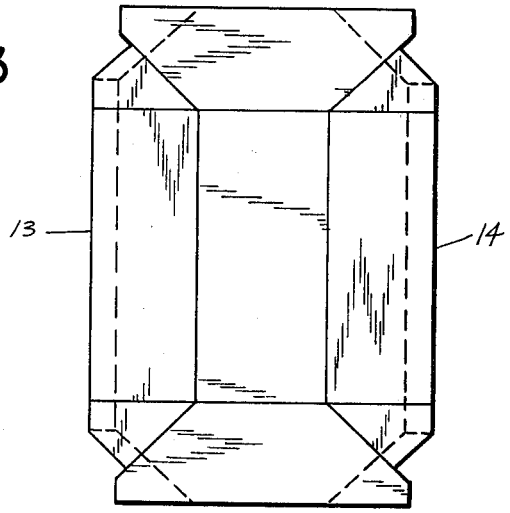
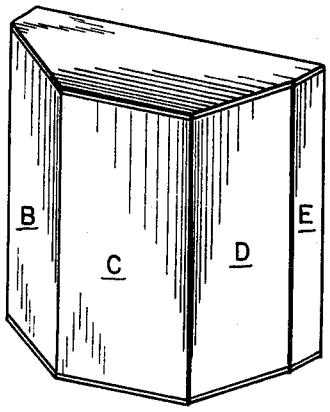
FIG.4

A+B=C+D+E

A+E+F = B+C+D

A+B=C+D+E

B+C=A+D+E+F

A+B=C+D+E

TUBULAR CARTON WITH POLYGONAL CROSS-SECTION

BACKGROUND OF THE INVENTION

The present invention relates to folding cartons and relates in particular to folding cartons which are fabricated into hollow tubular containers or irregular configuration in cross-section.

It is a particular feature of the present invention to provide a carton of the above general class which after gluing and erection into a hollow tubular form is collapsible into flat condition for convenient packing and shipment in large quantities to a filler unit.

It is a further feature of the invention to provide a blank of packaging material scored and formed with fold lines to define panels dimensioned in accordance with a predetermined system.

A further feature of the invention is the provision of a fabricated, glued, tubular or hollow container with at least four side panels defined by fold or score lines where the cross-section of the container is irregular i.e., takes the shape of concave or convex polygon, and the panels are so dimensioned that the container is collapsible into flat condition along said fold lines without mutilation of the panels or the glue seam.

The language "irregular cross-section" is intended to indicate that a plane passed through a body of a hollow tubular container embodying principles of the present invention and disposed normal to the longitudinal axis of the container will define a polygon of concave or convex shape and having sides of random lengths.

SUMMARY OF THE INVENTION

A folding carton embracing certain principles of the present invention may comprise a hollow container having at least four side panels defined by hinge lines, said container being hinged and glued together to define a hollow tubular structure, said hollow container defining an irregular planar configuration in cross-section, a first set of said panels being dimensioned from hinge to hinge such that the sum of said dimensions of said panels equals the sum of the hinge to hinge dimensions of a second set of said panels whereby said tubular container is collapsible into flat condition along hinge lines without mutilation of panels or destruction of glue seam.

A folding carton blank embracing certain other principles of the invention and susceptible of erection into a glued and hinged multi-panelled tubular or hollow container and collapsible into flat condition after erection may comprise a sheet of packaging material, said sheet being formed with a plurality of generally parallel score lines defining hinges and defining at least four side wall panels each having a specific width dimension measured from hinge to hinge, the width of said panels being so selected that upon erection into a tubular container said container defines a polygon in cross-section, said score lines being so spaced that the sum of the width dimensions of a first predetermined set of panels equals the sum of the width dimensions of a second predetermined set of panels whereby said tubular container is collapsible along certain score lines into flat condition without mutilation of panels or glue seam.

Other features and advantages of the present invention will become more apparent from an examination of the succeeding specification when read in conjunction with the appended drawings, in which;

BRIEF DESCRIPTION OF THE DRAWINGS

FIG. 1 shows a typical blank of packaging material embracing the principles of the present invention.

FIG. 2 shows the blank of FIG. 1 folded, glued and set up in the erect condition with end flaps open for filling.

FIG. 3 shows the hollow tubular container of FIG. 2 in the flat or collapsed condition.

FIG. 4 shows the container of FIG. 3 filled with product and with end flaps closed.

DESCRIPTION OF THE DISCLOSED EMBODIMENT OF THE INVENTION

Figure 5:
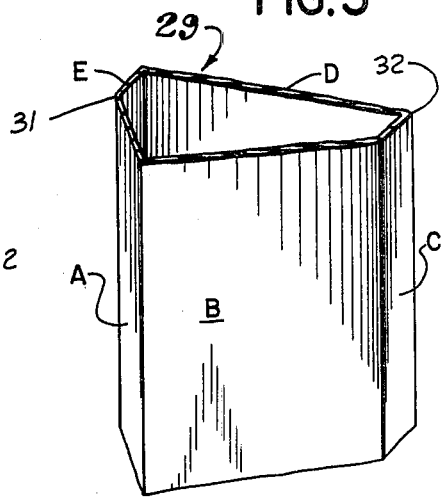
FIGS. 5 through 9A show erect hollow tubular containers (end flaps not shown) with various polygonal cross-sectional configurations illustrating a variety of shapes which can be developed using the principles of the present invention.

Referring now to FIG. 1 the reference number 11 indicates a blank of packaging material formed with a plurality of generally parallel score or hinge lines 13, 14, 16, 17, 18 and 19 hinging and bounding wall panels identified by the letters A through F. Glue or fastening flap G is hinged to the blank by the hinge line 19.

The reference numerals 21, 22, 23 and 24 identify generally closure flaps which do not figure critically in the principles of the present invention other than to note that such flaps are necessary, usual and customary, to close the container after product has been inserted into the hollow tube at a product filling station. Closure flaps of one kind or another are usually included in the basic carton blank as shown in FIG. 1.

The width dimension of a predetermined number of panels measured from hinge to hinge is so selected that the sum of the width dimensions of a predetermined group or set of panels equals the corresponding sum of width dimensions of a second predetermined group or set of panels so that upon fabrication of the blank into tubular form as shown in FIG. 2 with the glue flap sealed the tubular carton is susceptible subsequently of collapse into planar face-to-face condition, as in FIG. 3, along predetermined score or hinge lines without multilating the panels or the glue flap.

More specifically, note that the blank of FIG. 1 is so dimensioned that the sum of the width dimensions of panels B, C and D equals the corresponding sum of the width dimensions of panels A, E and F insuring that the tubular structure of FIG. 2 will collapse about hinge lines 13 and 17 with these lines defining the outer margins of the collapsed blank of FIG. 3.

Figure 5A:
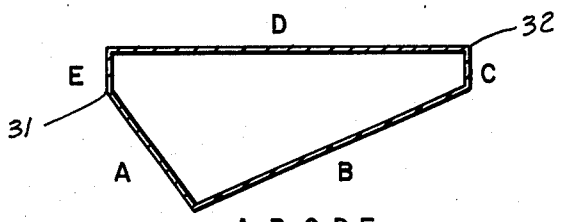

The tubular structure 29 of FIGS. 5 and 5A divides into a first panel group or set identified by the letters A and B and into a second panel group or set defined by panels C, D and E effective to collapse about score lines 31 and 32.

Figure 6:
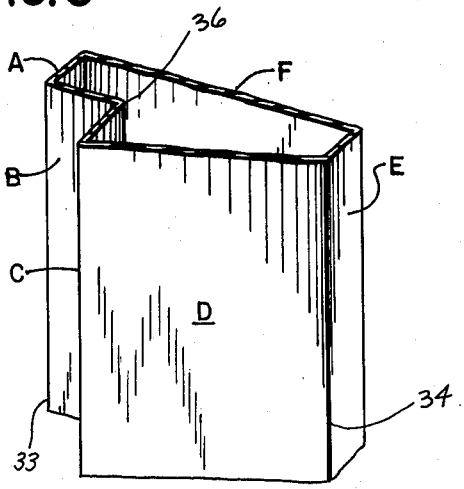
Figure 6A:
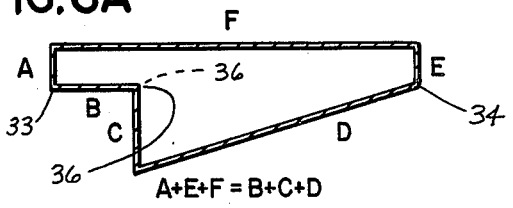

In FIGS. 6 and 6A the panel groups identified in the equation A+E+F equals B+C+D collapse about score lines 33 and 34. Note that score line 36 moves inwardly upon collapse along the path indicated by the dotted arrow line.

The tubes of FIGS. 7 and 7A and 8 and 8A collapse about score lines 37 and 38 and 39 and 41 respectively.

Figure 7:
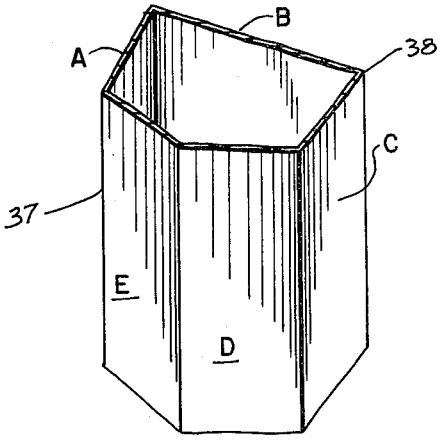
Figure 7A:
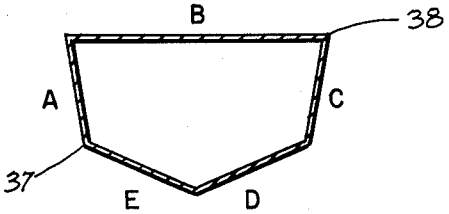
Figure 8:
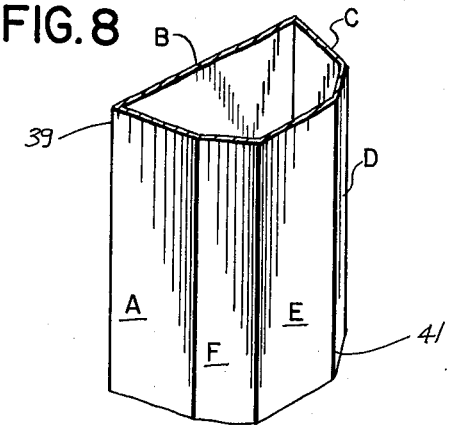
Figure 8A:
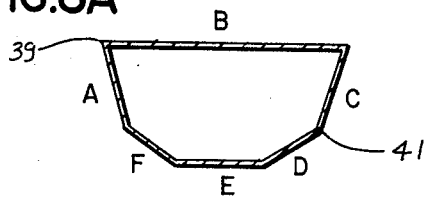
Figure 9:
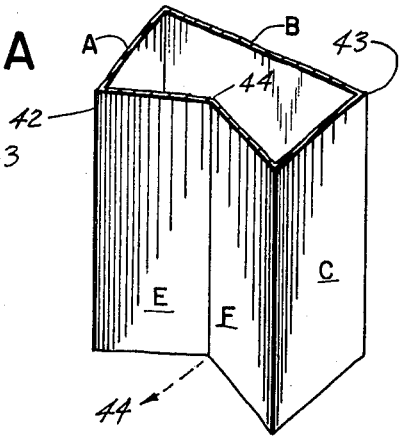
Figure 9A:
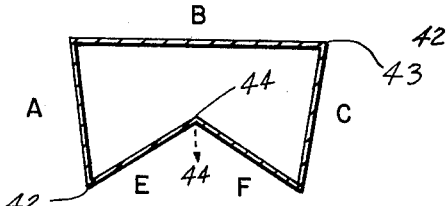

In FIGS. 9 and 9A the collapse occurs about score lines 42 and 43 and as in the embodiment of FIGS. 7 and 7A score line 44 moves (outwardly) upon collapse.

It will be noted from the drawings, and from the description of each illustrated embodiment, that all the hinge lines folded on collapsing the carton are located at edges of the panels, and thus at corners of the polygonal cross-sections, of the erected cartons. The drawings also illustrate that the hinge to hinge dimension of at least one of the panels in one recited set of panels is different from the hinge to hinge dimension of each panel, taken individually, in the second recited set of panels.

It is anticipated that a wide variety of embodiments and other modifications, such as design changes in end flaps, may be devised without departing from the spirit and scope of the present invention.

What is claimed is:

1. A tubular container comprising a plurality of panels bounded and joined by hinge lines and a fastening flap, said container in the erect condition defining a polygon in cross-section, said container being collapsible about predetermined hinge lines, said hinge lines being located at corners of said polygon, into a flat condition without mutilating or separating said panels, one predetermined contiguous set of said panels lying in generally planar face-to-face relation with a second predetermined contiguous set, comprising the remainder, of said panels, when the container is in the recited flat condition, the hinge to hinge dimension of at least one of said panels in said first set being different from the hinge to hinge dimension of each said panel, taken individually, in said second set.

2. The container of claim 1 in which the cross-section defines a concave polygon.

3. A folding carton blank susceptible of erection into a glued and hinged, multiple panel, tubular container having at least five sides when viewed in a cross-section, said tubular container being collapsible into a flat condition, comprising a sheet of packaging material, said sheet being formed with a plurality of generally parallel score lines defining a plurality of sidewall panels each having a specific width dimension, said panels being so dimensioned that upon erection into a tubular container said container defines a polygonal configuration in cross-section, the score lines being so spaced that the sum of the width dimensions of a first predetermined set of panels equals the sum of the width dimensions of a second predetermined set of panels whereby said tubular container is collapsible along certain score lines into a flat condition.

4. A tubular container comprising a plurality of panels bounded and joined by generally parallel hinge lines and a fastening flap, said container in the erect condition defining a polygon having at least five sides in cross-section, said container being collapsible about predetermined hinge lines into a flat condition without mutilating or separating said panels, one predetermined contiguous set of said panels lying in generally face-to-face relation with a second predetermined continguous set, comprising the remainder, of said panels, when the container is in the recited flat condition, the hinge to hinge dimension of at least one of said panels in said first set being different from the hinge to hinge dimension of each said panel, taken individually, in said second set.

5. The container of claim 1 or 4 in which the cross-section defines a convex polygon.

6. The container of claim 4, said predetermined hinge lines being located at corners of said polygon.

7. The container of claim 1, said container, in the erected condition, having at least five sides when viewed in a cross-section.

8. A folding carton blank susceptible of erection into a glued and hinged, multiple panel, tubular carton, said carton in the erect condition defining a polygon in cross-section, said carton being collapsible about predetermined hinge lines, said hinge lines being located at corners of said polygon, into a flat condition without mutilating or separating said panels, one predetermined contiguous set of said panels lying in generally planar face-to-face relation with a second predetermined contiguous set, comprising the remainder, of said panels, when the container is in the recited flat condition, the hinge to hinge dimension of at least one of said panels in said first set being different from the hinge to hinge dimension of each said panel, taken individually, in said second set.

* * * * *